US006615929B2

(12) United States Patent
Heckendorf

(10) Patent No.: US 6,615,929 B2
(45) **Date of Patent: *Sep. 9, 2003**

(54) METHOD AND APPARATUS FOR HIGH SPEED GRADING

(75) Inventor: David W. Heckendorf, Queensland (AU)

(73) Assignee: Savannah Smooth Roads, LLC, Savannah, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/812,736

(22) Filed: Mar. 20, 2001

(65) Prior Publication Data

US 2002/0014341 A1 Feb. 7, 2002

Related U.S. Application Data

(63) Continuation of application No. 09/173,859, filed on Oct. 16, 1998, now Pat. No. 6,206,106.

(60) Provisional application No. 60/204,152, filed on May 15, 2000.

(51) Int. Cl.[7] ..... E02F 3/76; A01B 15/00

(52) U.S. Cl. ..... 172/799.5

(58) Field of Search ..... 172/777, 799.5, 172/199, 445.1, 307, 260.5, 265, 794, 795, 261, 263, 264; 37/232, 234; 404/90; 405/271, 303

(56) References Cited

U.S. PATENT DOCUMENTS

| | | | | |
|---|---|---|---|---|
| 3,266,181 A | 8/1966 | Olafson | 37/169 |
| 3,276,153 A | 10/1966 | Sorensen | 37/148 |
| 3,352,036 A | 11/1967 | Miller | 37/108 |
| 3,435,546 A | 4/1969 | Iverson | 37/108 |
| 3,642,074 A | 2/1972 | Geurts | 172/261 |
| 3,716,105 A | 2/1973 | Hallam | 172/780 |
| 3,724,556 A | 4/1973 | Servatius | 172/4.5 |
| 4,217,962 A | 8/1980 | Schaefer | 172/197 |
| 4,364,191 A | 12/1982 | Cazes | 37/2 R |
| 4,369,590 A | 1/1983 | Miller | 37/231 |
| 4,393,608 A | 7/1983 | Hodge | 37/124 |
| 4,403,432 A | 9/1983 | Biance | 37/235 |
| 4,490,929 A | 1/1985 | Lucas | 37/129 |
| 4,568,219 A | 2/1986 | Berry | 404/118 |
| 4,700,786 A | 10/1987 | Berry | 172/799.5 |
| 4,802,293 A | 2/1989 | Smith | 37/108 R |
| 4,976,052 A | 12/1990 | Jeane | 37/109 |
| 5,289,880 A | 3/1994 | Barto | 172/799.5 |
| 5,562,365 A | 10/1996 | Berrange | 405/271 |
| 5,833,012 A | 11/1998 | Pierce et al. | 172/199 |
| 5,890,546 A | 4/1999 | Kerpash, Sr. | 172/684.5 |
| 5,921,010 A | 7/1999 | Schulte et al. | 37/232 |
| 6,021,853 A | 2/2000 | Atkins | 172/780 |
| 6,206,106 B1 * | 3/2001 | Heckendorf | 172/799.5 |

* cited by examiner

*Primary Examiner*—Robert E. Pezzuto
(74) *Attorney, Agent, or Firm*—Quarles & Brady LLP

(57) ABSTRACT

A method and apparatus for high speed grading a road in a single pass. The grader including a frame supported above a surface. At least one blade is pivotally fixed to the frame, and is positionable to engage the surface. A first biasing mechanism biases the blade toward a forward position. At least one leveling board is pivotally fixed to the frame, and is positionable to engage the surface rearwardly of the blade. A second biasing mechanism biases the leveling board toward a forward position. A packing mechanism is fixed rearwardly of the leveling board, and is positionable to engage the surface.

26 Claims, 8 Drawing Sheets

METHOD AND APPARATUS FOR HIGH SPEED GRADING

CROSS REFERENCE TO RELATED APPLICATIONS

This application is a continuation of U.S. patent application Ser. No. 09/173,859 filed on Oct. 16, 1998 now U.S. Pat. No. 6,206,106, and claims priority to U.S. Provisional Patent Application No. 60/204,152 filed on May 15, 2000.

STATEMENT REGARDING FEDERALLY SPONSORED RESEARCH OR DEVELOPMENT (Not Applicable)

BACKGROUND OF THE INVENTION

The present invention relates generally to a method and apparatus for grading, and more particularly to a method and apparatus for grading surfaces of roads, including gravel roads and unmade roads.

It is well known for road working equipment, such as road graders, to have a single large blade which is supported between front and rear wheels to effect grading of roads. The known equipment is typically very large to provide sufficient force to support the blade when cutting or shifting substantially embedded rocks or substantial quantities of earth during a grading operation. The large equipment is generally expensive to manufacture and, thus purchase. Moreover, in order to not unduly damage the blade or other components of the equipment, the grading speed of such equipment is usually kept to a very slow speed, such as approximately 3–5 miles per hour (mph). Therefore a need exists for a road grader which can operate at speeds which are higher than typical road grading speeds, and which is not unduly damaged when the grader blade strikes an object.

SUMMARY OF THE INVENTION

The present invention provides a grader including a frame supported above a surface. At least one blade is pivotally fixed to the frame, and is positionable to engage the surface. A first biasing mechanism biases the blade toward a forward position. At least one leveling board is pivotally fixed to the frame, and is positionable to engage the surface rearwardly of the blade. A second biasing mechanism biases the leveling board toward a forward position. A packing mechanism is fixed rearwardly of the leveling board, and is positionable to engage the surface.

Another aspect of the present invention is a method of grading a surface of a road including reclaiming the road surface with at least one blade in a single pass, smoothing the reclaimed surface with at least one leveling board in the same pass as reclaiming the road surface, and packing the smoothed, reclaimed road surface in the same pass as smoothing the reclaimed surface.

A general objective of the present invention is to provide a grader which can grade a road by cutting, smoothing, and packing a road in a single pass. This objective is accomplished by providing a grader with a cutting blade, a leveling board, and a packing mechanism which operate as the grader travels along the road being reclaimed.

Another objective of the present invention is to provide a grader which can grade a road at a high speed. This objective is accomplished by providing a grader which can operate at speeds which are greater than conventional grading speeds. Preferably, the grader operates at a speed of at least 12 mph. Most preferably, the grader operates at speeds of at least 8 mph.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE DRAWINGS

Figure 1:
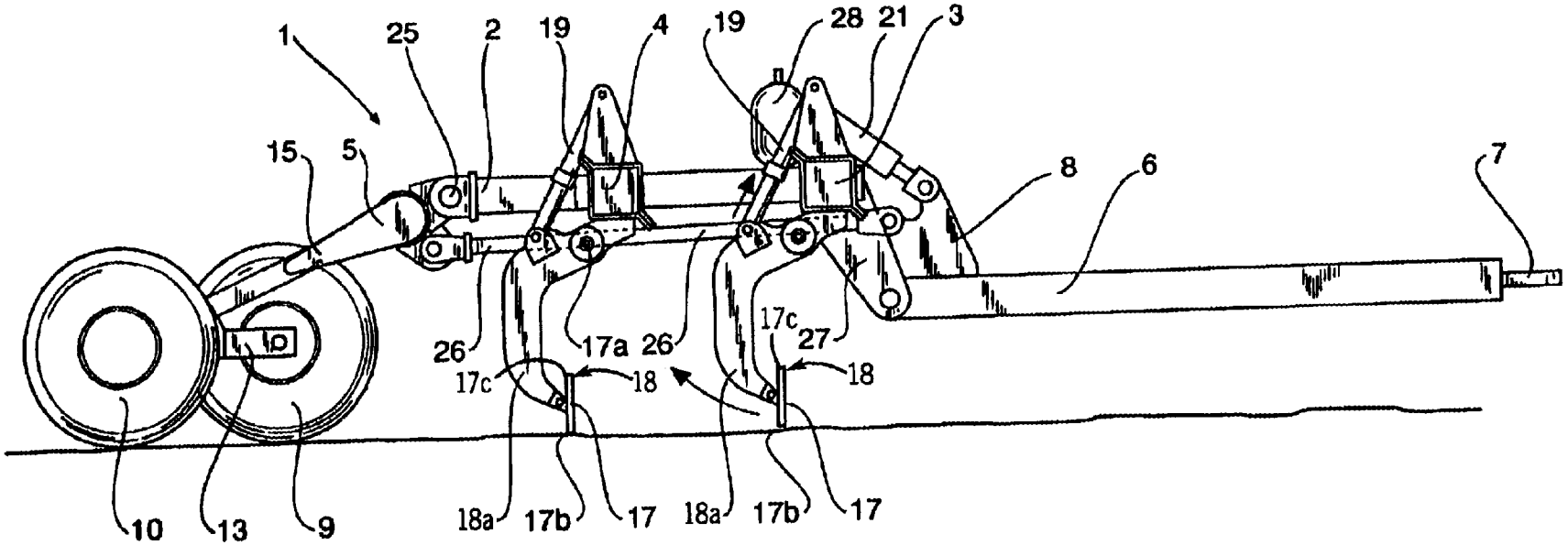
FIG. 1 is a side view of a grader according to an embodiment of the invention.
Figure 2:
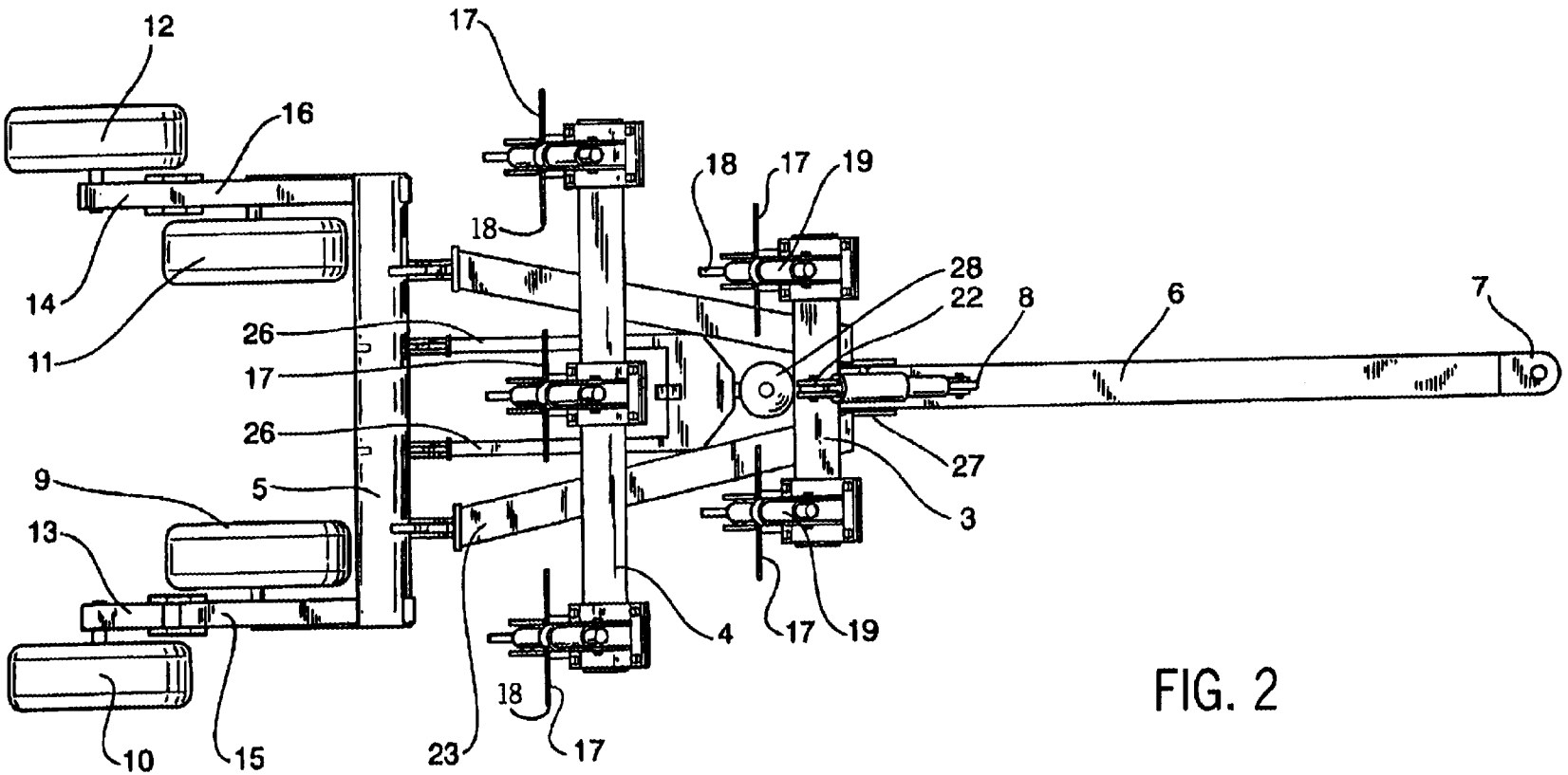
FIG. 2 is a top plan view of grader of FIG. 1.
Figure 3:
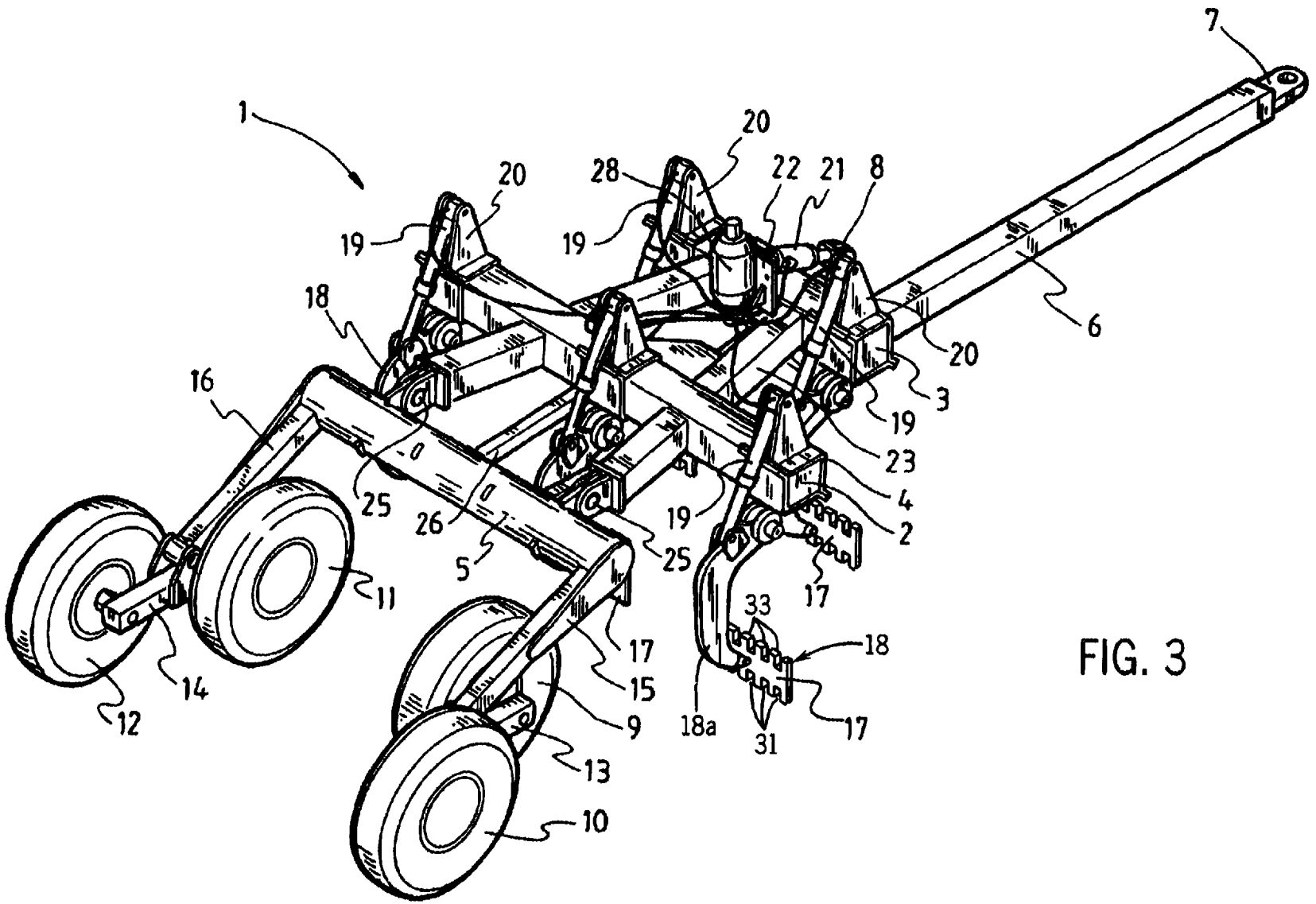
FIG. 3 is a perspective view of the grader of FIG. 1.
Figure 4:
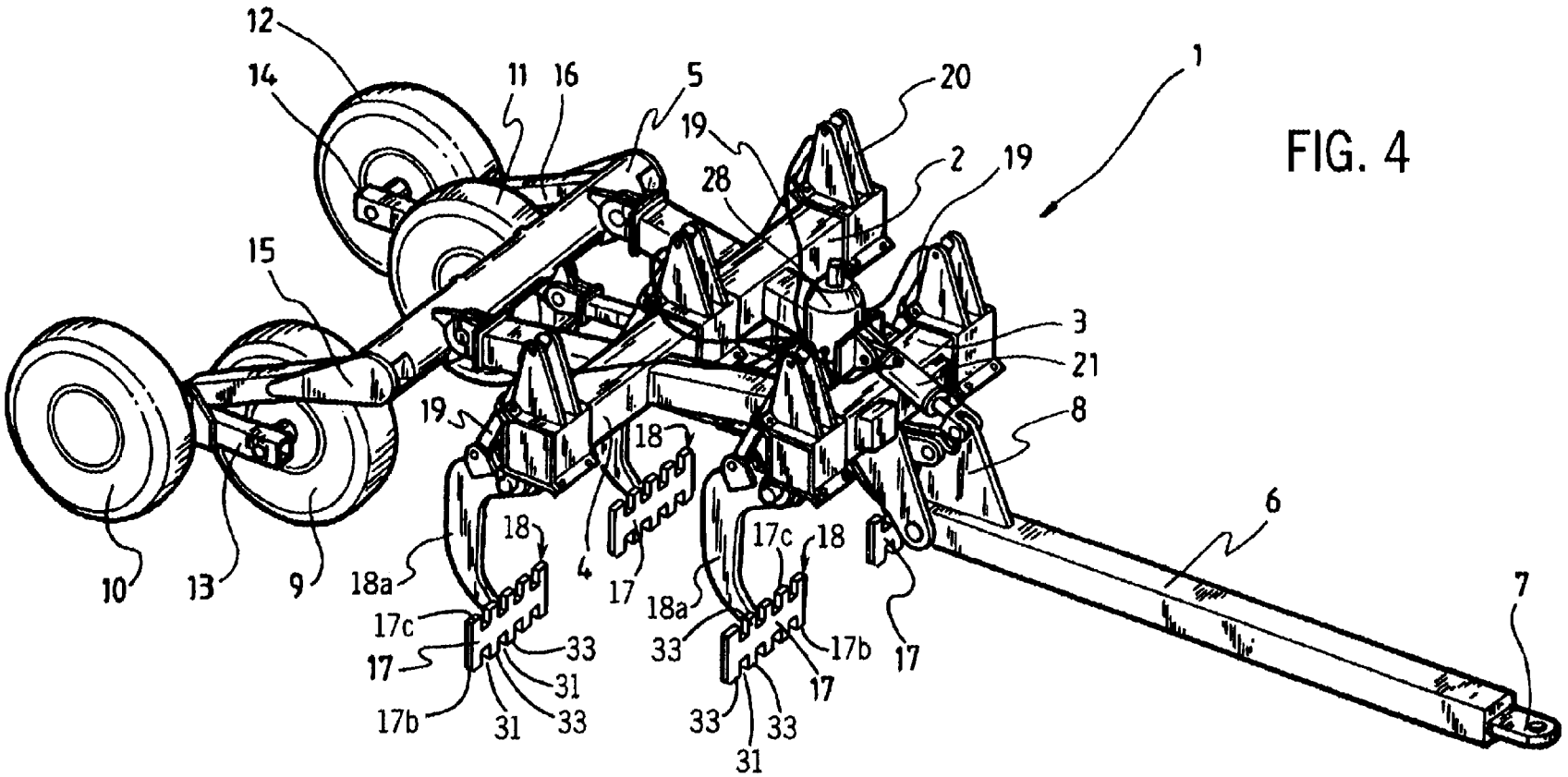
FIG. 4 is a further perspective view of the grader of FIG. 1.
Figure 5:
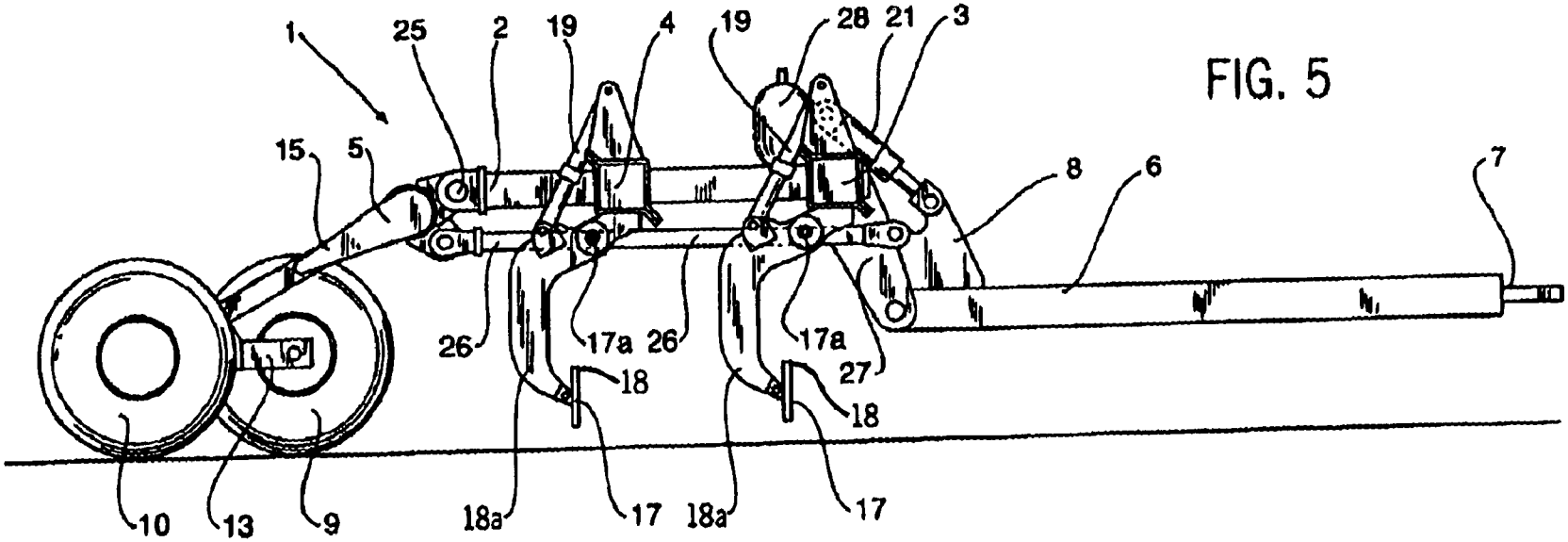
FIG. 5 is a side view of the grader of FIG. 1, with the draft frame hydraulic ram extended so as to show a collective lift to the blades.
Figure 6:
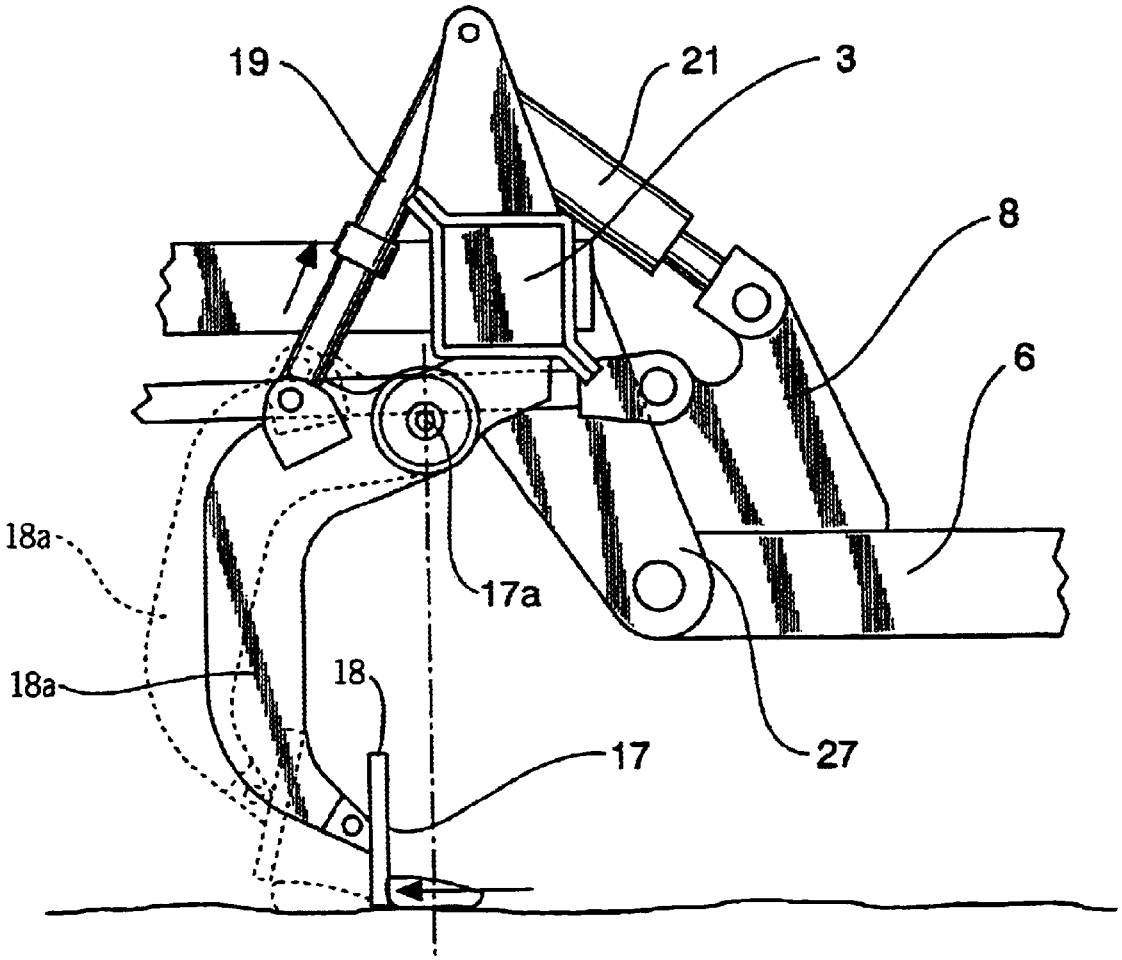
FIG. 6 is an enlarged side view of a portion of the grader of FIG. 1, with the position of the blade and leg pivoted backward as it clears an obstacle.
Figure 7:
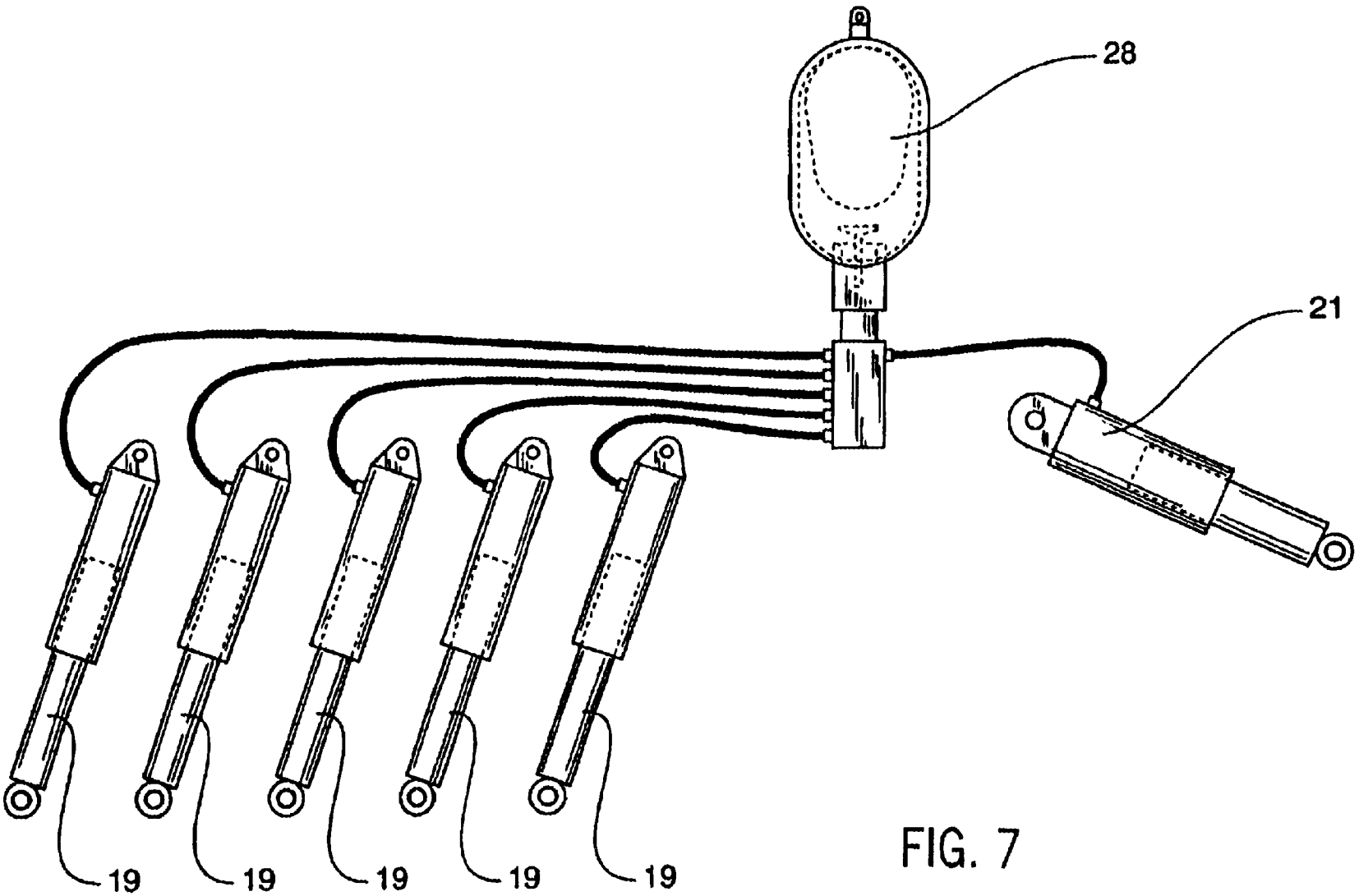
FIG. 7 is a schematic view of rams and a gas accumulator for use with a grader according to the invention.

A grader 1, 30, as shown in FIGS. 1–9, can be towed by any conventional tow vehicle, such as a truck or a sport utility vehicle to grade surface, such as a road. Preferably, the grader 1, 10 is operated at speeds of at least 12 miles per hour without unduly stressing the hitch and other parts of the tow vehicle. Most preferably, the grader 1, 30 is operated at a speed of at least 8 mph. The grader 1, 30 can be towed without being substantially adjusted upon arrival at the work site. Although the preferred embodiment is towed behind a conventional vehicle, the present invention can be self propelled without departing from the scope of the present invention.

Referring to FIGS. 1–7, the grader 1 includes a draft frame 2 having a front cross bar 3, a middle cross bar 4 and a rearward cross bar 5. The draft frame 2 also includes a forwardly extending draft arm 6 having a head 7 at the forward most end of the draft arm 6. The head 7 is adapted to conventionally connect to the tow vehicle, such as by a hitch point having rotational freedom.

As shown in FIG. 1, the grader 1 has ground engaging wheels 9, 10, 11, 12. Any suitable number of wheels 9, 10, 11, 12 is acceptable. For example, the grader 1 can have a pair of wheels in place of each of wheels 9, 10, 11, 12. The wheels 9, 10,11, 12 are pivotally connected to the frame 2 by support beams 13, 14, and the orientation of the rearward cross bar 5 can govern the position of arms 15, 16. Preferably, an outer end of each arm 15, 16 is pivotally connected to the support beams 13, 14.

A plurality of cutting blades 18 for reclaiming the surface is pivotally fixed to the draft frame cross members 3, 4. Each blade is fixed to the frame 2, such as described below, in a vertical position relative to the surface being graded. Preferably, each cutting blade 18 is independently supported at the end of a leg 18*a* pivotally connected to the frame 2 at a pivotal connection 17*a*, so as to present the blades 18 in a staggered alignment.

Each cutting blade 18 can be formed of any suitable material, and includes a ground engaging grading face 17 having a lowermost grading edge 17*b* and an uppermost edge 17*c*. Preferably, the blades 18 are formed of steel with tungsten-carbide edges 17*b*, 17*c*. Each of the blades 18 are supported by the leg 18*a* so that the grading face 17 has a planar front surface defining thereby a plane that will be aligned in a perpendicular alignment to an expected forward direction of the grader 1. In the embodiment shown in FIGS. 1–7, the lowermost edge 17*b* of the grading face 17 is linear and aligned in a horizontal alignment with the ground.

Each edge 17*b*, 17*c* of the cutting blade 18 has notches 31 formed therein. The notches 31 define teeth 33 which can engage the ground. The teeth 33 formed on the edges 17*b*, 17*c* of the cutting blade 18 provide a grading face 17 with a longer life than conventional blades. In particular, a blade 18 having worn teeth 33 on one edge 17*b* can be rotated approximately 180 degrees automatically or manually, thereby exposing another edge 17*c* of the cutting blade 18 with unworn teeth 33. Preferably, each cutting blade 18 is detachably fixed to the leg 18*a*, such as by bolts. When rotating the blade 18, the blade 18 is detached from the leg 18*a*, rotated approximately 180 degree, and then reattached to the leg 18*a* to expose the unworn teeth 33 for engagement with the ground.

Each pivotally connected leg 18*a* supports one of the blades 18 in at least two positions relative to the draft frame 2, a first of these being a grading position, and a second of these being a release position. Preferably, each cutting blade 18 is maintained in the grading position under individual pressure from a hydraulic ram 19, there being one ram 19 each for each of the blades 18 which in turn is connected to an accumulator 28. Preferably, the hydraulic ram 19 in each case is connected to the gas accumulator 28, such as fully described in copending U.S. patent application Ser. No. 09/173,859 which is fully incorporated herein by reference. The degree of change in pressure caused by a shift in the position of the blade 18 can be small so that the loading on the machine from an increase in diversion pressure of one or more of the blades 18 can be small.

Preferably, each blade 18 is supported so as to be, when in its forward most position, entirely rearward of a vertical plane passing through the axis of the pivot connection 17*a* for the leg 18*a* supporting that blade 18, so that rearward pivoting of the leg 18*a* about its respective connection 17*a* will result in only rearward and upward motion of the blade 18 relative to the pivot axis. Thus, there can be a clearing pressure so that the front of the grading face 17 of the blade 18 will increasingly incline with a lowermost edge 17*b* more rearward than the uppermost edge 17*c*. Consequently, the blade 18 can ride over an obstacle or soften the impact with an obstacle.

As described in copending U.S. patent application Ser. No. 09/173,859, the gas accumulator 28 can be coupled collectively to the hydraulic rams 19 so that each hydraulic ram 19 can be held in a forward most position with a pressure of 1200 pounds per square inch. If the cutting blade 18 is forced rearwardly by four inches, such as by striking an object in the road, the pressure against the hydraulic ram 19 can increase to 1220 pounds per square inch. Moving the cutting blade 18 rearwardly by a distance of four inches can cause the cutting blade 18 to be angled at approximately 15 degrees relative to an axis extending from the top to the bottom of the grader 1, and raises the cutting blade lowermost edge 17*b* approximately one inch above the top of the surface being graded. In this manner, the grader 1 can operate at high speeds, such as 12 mph, as compared to conventional graders, without subjecting the grader 1 or a vehicle towing the grader 1 to loads which will damage the tow vehicle or the grader 1. Preferably, the grader 1 is operated at a speed of at least 8 mph when reclaiming a road surface. Of course, the grader 1 can be operated at conventional speeds without departing from the scope of the present invention.

The grader 1 can also have adjusting structure which can raise and lower one or more cutting blades 18 between an upper and a lower position in the event the grading pressure against is above a selected pressure. Such adjusting structure can include a hydraulic ram 21, and a linkage which includes elongate members 23 joined to the draft frame 2 by a pivot connection 22 at one end and pivot connection 25 at the other end. Elongate members 26 are pivotally connected to the draft frame 2 at a front of the apparatus and the rearward cross bar 5 at a back end and arranged so that in one position of the draft frame hydraulic ram 21, the draft frame 2 is supported in the upper position which is higher relative to the frame head 7 and the ground engaging wheels 9, 10, 11, 12 as compared to lower position.

As described in copending U.S. patent application Ser. No. 09/173,859, the pressure in each of the hydraulic rams 19 supporting each of the blades 18 can be coupled to the common plenum gas accumulator 28, which can also be coupled to the draft frame hydraulic ram 21. When additional pressure against the cutting blades 18 occurs with such pressure being transmitted to each of the hydraulic rams 19, there can be an increase in the plenum pressure of the gas accumulator 28. As a result, there can be a small increase in pressure in the draft frame hydraulic ram 21.

The linkage arrangement and the relative sizes of the rams and other parts are preferably selected so that if only one cutting blade 18 is under higher pressure, there is not necessarily a substantial increase in the length of ram 21. If two or more of the cutting blades 18 are simultaneously brought under substantial pressure, there can be a more significant lengthening of the ram 21 and a raising of the level of the supporting cross arms 3 and 4, which can lift to a modest extent all of the cutting blades 18.

The grader 1 can be towed behind the tow vehicle where supervision and constant monitoring of the cutting blade levels is not so critical. Furthermore, the cutting blades 18 can be drawn along the road at a speed governed by the response available from the hydraulics and the clearing effect provided by the inclining of the blade 18 to provide a clearing effect rather than being constantly controlled in a manual way by an operator. Of course, the level of each cutting blade 18 can also be conventionally controlled manually or automatically by an operator.

One of the advantages of the arrangement having the above features is that by having individual blades 18 which are aligned in staggered fashion so that any individual blade 18 engages only part of the surface to be graded, is that in the event that one blade 18 strikes a rock, then the force available to resist a quick release of that blade 18 from a grading position to a release position is somewhat smaller than would be the case if there was one big single blade. Further, while one blade 18 releases, the other blades 18 can continue to grade at a lower level therefore at least continuing to provide an effective grading effect. However, when two or more blades 18 start to encounter rocks very much at the same time or encounter an amount of earth causing large stresses on the cutting blades 18 and, consequently, the grader 1 and/or tow vehicle, there is additional pressure from the several hydraulic rams 19 being pushed into a release position. This pressure can raise the pressure in a draft frame hydraulic ram 21, which can collectively lift all of the blades 18 to a higher position at least until the substantial load decreases.

Figure 8:
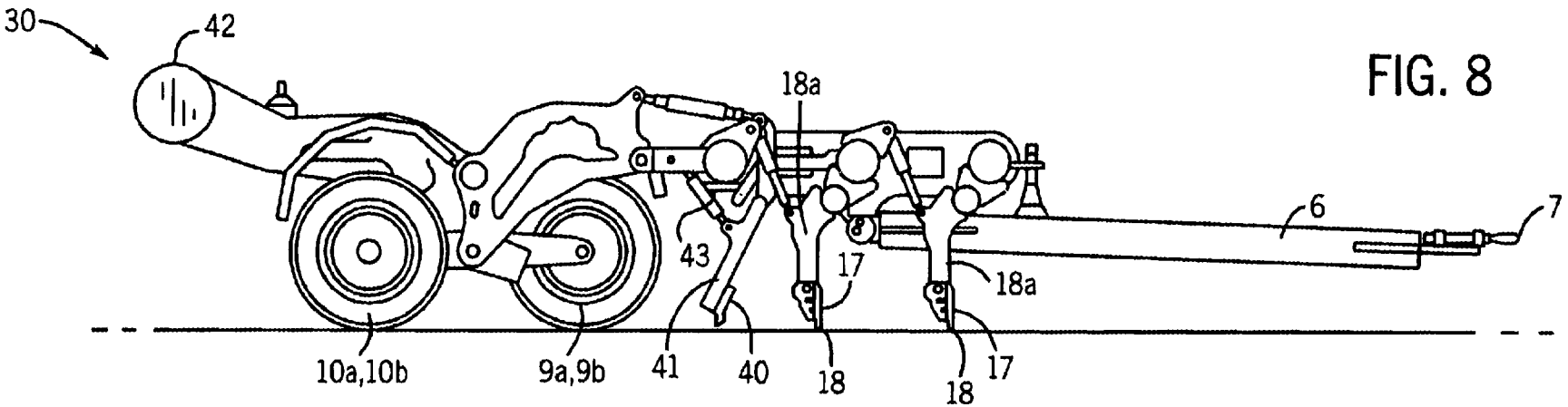
FIG. 8 is a side view of a grader according to an alternative embodiment of the invention.
Figure 9:
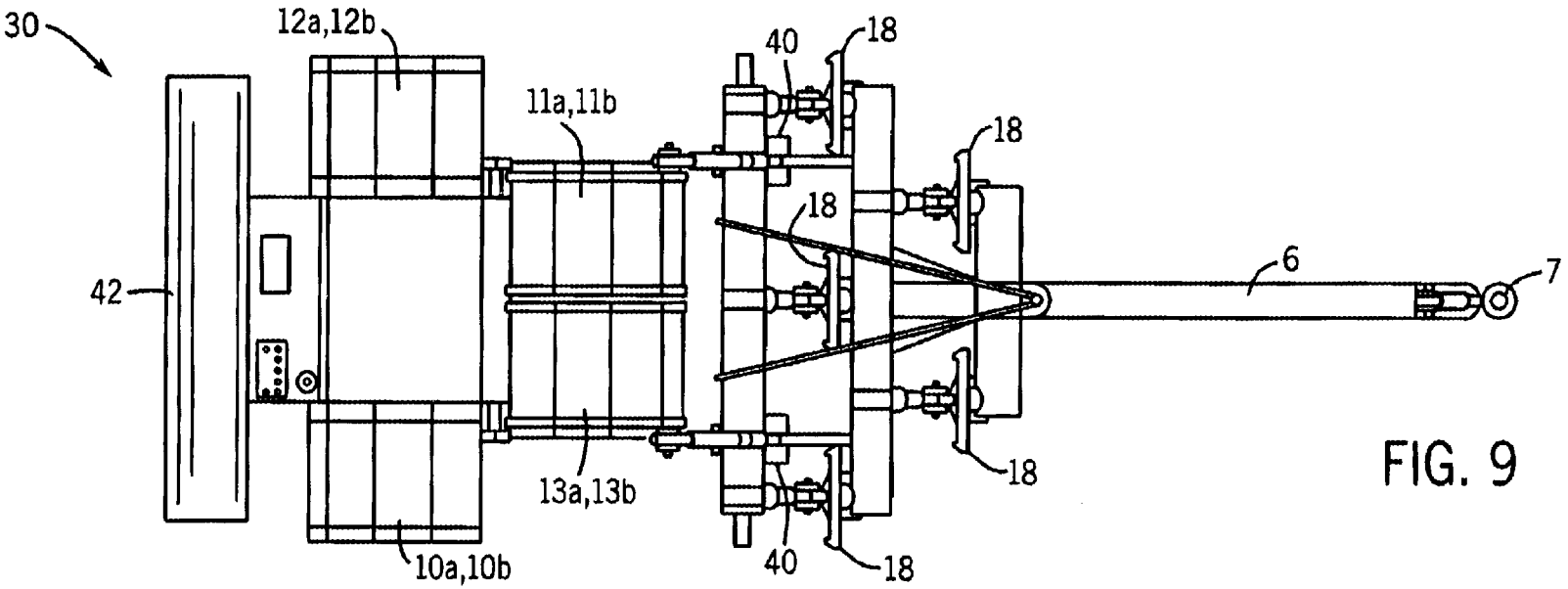
FIG. 9 is a top plan view of the grader of FIG. 8.

FIGS. 8 and 9 show an alternative embodiment of the grader 30 having leveling boards 40 positioned between the cutting blades 18 and wheels 9*a*, 9*b*, 10*a*, 10*b*, 11*a*, 11*b*, 12*a*, 12*b*. The grader 30 includes one or more cutting blades 18 for reclaiming the surface, one or more leveling boards 40 for smoothing the reclaimed surface, and one or more wheels 9*a*, 9*b*, 10*a*, 10*b*, 11*a*, 11*b*, 12*a*, 12*b* for packing the surface.

As in the first embodiment, the grader 30 is preferably configured to be towed by any suitable conventional vehicle, such as a truck or a sport utility vehicle, and can be towed during operation at speeds of at least 12 miles per hour without mechanical risk to the grader 30 or the operator of the grader 30. Preferably, the grader 30 can be towed at least 8 mph which is still high relative to the operational speeds of conventional graders. The relatively high speeds at which the grader 30 can travel to a work site and grade a surface allows for more frequent, lower cost road maintenance, especially for dirt roads which are widely dispersed and short stretches of roads that would be uneconomical to maintain with a conventional road grader.

The operator of the grader 30 can control the depth of each of the cutting blades 18 and leveling boards 40 in relation to the surface which is being graded. The invention is not limited in that regard, however, as the grader 30 can have a hydraulic system that automatically raises a plurality of cutting blades 18 and/or leveling boards 40 if the pressure against some or all of such cutting blades 18 and leveling boards 40 becomes to great. Consequently, if a cutting blade 18 or leveling board 40 strikes an object such as a rock or a stump, the cutting blade 18 and/or leveling board 40 can release backwards and over the obstruction. If a large obstruction is encountered, the entire frame can release upwards, protecting the tow vehicle from the shock loading which is normally associated with high speed grading.

The hydraulic system can include a direct current electric/hydraulic powerpack, a nitrogen accumulator, one or more lift cylinders, and a plurality of displacement cylinders. Preferably, the hydraulic system has a 12 volt direct current powerpack, a four liter nitrogen accumulator, two lift cylinders, and seven displacement cylinders.

The cutting blades 18 can be individually adjustable to set the grading face 17 at one or more angles relative to an axis extending from the front to the rear of the grader 30. In a particularly preferred embodiment, the angle adjustable grading faces 17 can be set to at least one of the following angles relative to the axis extending from the front to the rear of the grader: 40 degrees, 25 degrees, 0 degrees, −25 degrees, and −40 degrees.

Each cutting blade 18 can be fixed to a bracket, such as by bolts, which is rotatably fixed to the leg 18*a*. The bracket is fixable relative to the axis extending from the front to the rear of the grader at predetermined positions corresponding to the above angles, such as by a pin extending through holes formed in the bracket and leg 18*a*.

Preferably at least one leveling board 40 is supported on each side of the grader 30 by leg 41 pivotally mounted to the grader 30. In a particularly preferred embodiment, the leveling boards 40 are fixed to the grader 1 rearwardly of the cutting blades 18, and are angled in the same directions as the cutting blade grading face 17 forward of each respective leveling board 40, allowing improved movement of reclaimed road matter to the center of a road to form or maintain a crown. Preferably, the leveling boards 40 are biased using a hydraulic ram 43 to urge each board 40 forwardly. Although a hydraulic ram 43 is preferred, other methods known in the art for biasing a member, such as a spring, can be used without departing from the scope of the invention.

Each leveling board 40 can be extended on the outside of the grader 30, that is outwardly past the outer edge of the cutting blades 18 in order to smooth a berm on the road and avoid a small crease from being formed by the outside edge of the cutting blades 18. The leveling boards 40 can be formed of any suitable material, and are preferably formed of steel. The tips of the leveling boards 40 are preferably formed of tungsten-carbide.

The wheels 9*a*, 9*b*, 10*a*, 10*b*, 11*a*, 11*b*, 12*a*, and 12*b* can be a plurality of wide tire wheels which are fixed to the grader frame rearwardly of the leveling boards 40, and follow the leveling boards to compact the graded and smoothed surface. The wheels 9*a*, 9*b*, 10*a*, 10*b*, 11*a*, 11*b*, 12*a*, and 12*b* can also carry the load of the grader. A tank 42 can be fixed to the grader 30 which adds to the weight of the grader 30, thereby improving the ability of the grader 30 to compact the surface. The tank 42 is preferably located near the rear of the grader 30. Preferably, the tank weight can be increased by filling the tank 42 with any material suitable for increasing the weight of the tank 42, such as water.

The grader 30 can electrically communicate with the tow vehicle by which it is being towed. Accordingly, the grader 30 can have lights, brakes, and a hydraulic control which are charged by the tow vehicle. Advantageously, the grader 30 can be configured to have these systems charged by the tow vehicle when the engine of the tow vehicle is operating. Alternatively, the grader can have independent systems which are not connected to the tow vehicle.

It should be understood that the examples and embodiments described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

I claim:

1. A grader including:

a frame supported above a surface at least one blade pivotally fixed to said frame, and being positionable to engage the surface;

a first biasing mechanism biasing said blade toward a forward position;

at least one leveling board pivotally fixed to said frame, and being positionable to engage the surface rearwardly of said blade;

a second biasing mechanism biasing said leveling board toward a forward position; and a packing mechanism fixed rearwardly of said leveling board, and being positionable to engage the surface.

2. The grader of claim 1, in which said blade is supported by a leg joined to said frame by a pivot connection.

3. The grader of claim 1, in which said first biasing mechanism includes a hydraulic ram, the pressure of said hydraulic ram being governed by hydraulic pressure of fluid within said hydraulic ram, and the fluid is hydraulically connected to an accumulator.

4. The grader of claim 3, in which said second biasing mechanism includes a hydraulic ram urging said leveling board toward the forward position.

5. The grader of claim 1, in which said packing mechanism includes at least one wheel rotatable about an axis transverse to the direction of travel of the frame.

6. The grader of claim 1, in which said packing mechanism includes a tank tillable with a material which increases the weight of the packing mechanism.

7. The grader of claim 1, in which said blade has more than one edge, and at least one of said edges has a notched face forming teeth engageable with the surface.

8. The grader of claim 7, in which at least two of said edges has a notched face, and one of said edges is engagable with the surface, wherein said blade is positionable to engage a different one of said edges with the ground.

9. The grader of claim 1, in which said blade is adjustable relative to an axis extending from the front to the rear of the frame.

10. The grader of claim 1, in which said leveling board is adjustable relative to an axis extending from the front to the rear of the frame.

11. The grader of claim 1, in which said frame includes a hitch point for coupling said frame to a tow vehicle.

12. A method of grading a surface of a road including reclaiming the road surface with at least one blade in a single pass;

smoothing the reclaimed surface with at least one leveling board in the same pass as reclaiming the road surface; and packing the smoothed, reclaimed road surface in the same pass as smoothing the reclaimed surface.

13. The method of claim 12, in which reclaiming the road surface includes pivoting said blade rearwardly when said blade encounters an obstruction in the road.

14. The method of claim 13, in which reclaiming the road surface includes urging said blade toward a forward position.

15. The method of claim 12, in which smoothing the reclaimed road surface includes pivoting said leveling board rearwardly when said leveling board encounters an obstruction in the road.

16. The method of claim 15, in which smoothing the reclaimed road surface includes urging said smoothing board toward a forward position.

17. The method of claim 12, including towing a frame supporting said blade.

18. The method of claim 12 in which said single pass is performed at a speed of at least 8 mph.

19. A grader having at least one grader blade, said blade being positioned to effect grading of a surface, said blade being supported by a leg joined to a support frame by a pivot connection, the position of said blade being maintained in a forward position by a hydraulic ram the pressure of which is governed by hydraulic pressure of fluid within the ram which fluid is hydraulically connected to an accumulator, wherein the accumulator is mounted on the support frame so that the hydraulic pressure in the ram is substantially the pressure within the accumulator;

at least one leveling board fixed rearwardly of said blade, said leveling board being positioned to effect smoothing of at least a portion of the surface, said leveling board being supported by a leg joined to the support frame by a pivot connection;

a biasing member urging said leveling board toward a forward position; and at least one wheel rotatably mounted rearwardly of said mounting board, said wheel being positioned to effect packing of at least a portion of the surface.

20. The grader of claim 19, in which said wheel supports a tank which is fillable with a material which increases the weight supported by said wheel.

21. The grader of claim 19, in which said blade has more than one edge, and at least one of said edges has a notched face forming teeth engageable with the surface.

22. The grader of claim 21, in which at least two of said edges has a notched face, and one of said edges is engagable with the surface, wherein said blade is positionable to engage a different one of said edges with the ground.

23. The grader of claim 19, in which said blade is adjustable relative to an axis extending from the front to the rear of the frame.

24. The grader of claim 19, in which said leveling board is adjustable relative to an axis extending from the front to the rear of the frame.

25. The grader of claim 19, in which said biasing member is a hydraulic ram.

26. The grader of claim 19, in which said frame includes a hitch point for coupling said frame to a tow vehicle.

* * * * *

UNITED STATES PATENT AND TRADEMARK OFFICE

CERTIFICATE OF CORRECTION

PATENT NO. : 6,615,929 B2
DATED : September 9, 2003
INVENTOR(S) : Heckendorf

It is certified that error appears in the above-identified patent and that said Letters Patent is hereby corrected as shown below:

Column 7,
Line 2, “tillable” should be -- fillable --

Signed and Sealed this

Thirty-first Day of August, 2004

JON W. DUDAS
*Director of the United States Patent and Trademark Office*